US006789332B1

(12) United States Patent
Scholz

(10) Patent No.: US 6,789,332 B1
(45) Date of Patent: Sep. 14, 2004

(54) SOLE FOR A SHOE WITH SPRING AND DAMPING ELEMENTS

(75) Inventor: Wolfgang Scholz, Lonnerstadt (DE)

(73) Assignee: adidas International Marketing B.V., Amsterdam (NL)

( * ) Notice: Subject to any disclaimer, the term of this patent is extended or adjusted under 35 U.S.C. 154(b) by 0 days.

(21) Appl. No.: 10/111,060

(22) PCT Filed: Oct. 9, 2000

(86) PCT No.: PCT/EP00/09888

§ 371 (c)(1),
(2), (4) Date: Apr. 18, 2002

(87) PCT Pub. No.: WO01/28376

PCT Pub. Date: Apr. 26, 2001

(30) Foreign Application Priority Data

Oct. 18, 1999 (DE) ..... 199 50 121

(51) Int. Cl.[7] ..... A43B 13/14

(52) U.S. Cl. ..... 36/27; 36/103; 36/59 C; 36/25 R

(58) Field of Search ..... 36/103, 107, 27, 36/28, 59 R, 59 C, 25 R

(56) References Cited

U.S. PATENT DOCUMENTS

| | | | | | |
|---|---|---|---|---|---|
| 5,185,943 | A | * | 2/1993 | Tong et al. | 36/28 |
| 5,279,051 | A | * | 1/1994 | Whatley | 36/25 R |
| 5,325,611 | A | * | 7/1994 | Dyer et al. | 36/30 R |
| 5,642,575 | A | * | 7/1997 | Norton et al. | 36/27 |
| 5,937,545 | A | * | 8/1999 | Dyer et al. | 36/35 R |
| 5,974,695 | A | * | 11/1999 | Slepian et al. | 36/27 |

* cited by examiner

*Primary Examiner*—Ted Kavanaugh
(74) *Attorney, Agent, or Firm*—Testa, Hurwitz & Thibeault, LLP

(57) ABSTRACT

The present invention relates to a sole for a shoe, in particular for a sports shoe with a support plate, at least one damping element arranged below the support plate and at least one spring element mounted to the support plate, where the spring element is essentially L-shaped and thereby encompasses the damping element from the side and from below.

16 Claims, 3 Drawing Sheets

SOLE FOR A SHOE WITH SPRING AND DAMPING ELEMENTS

TECHNICAL FIELD

Figure 1:
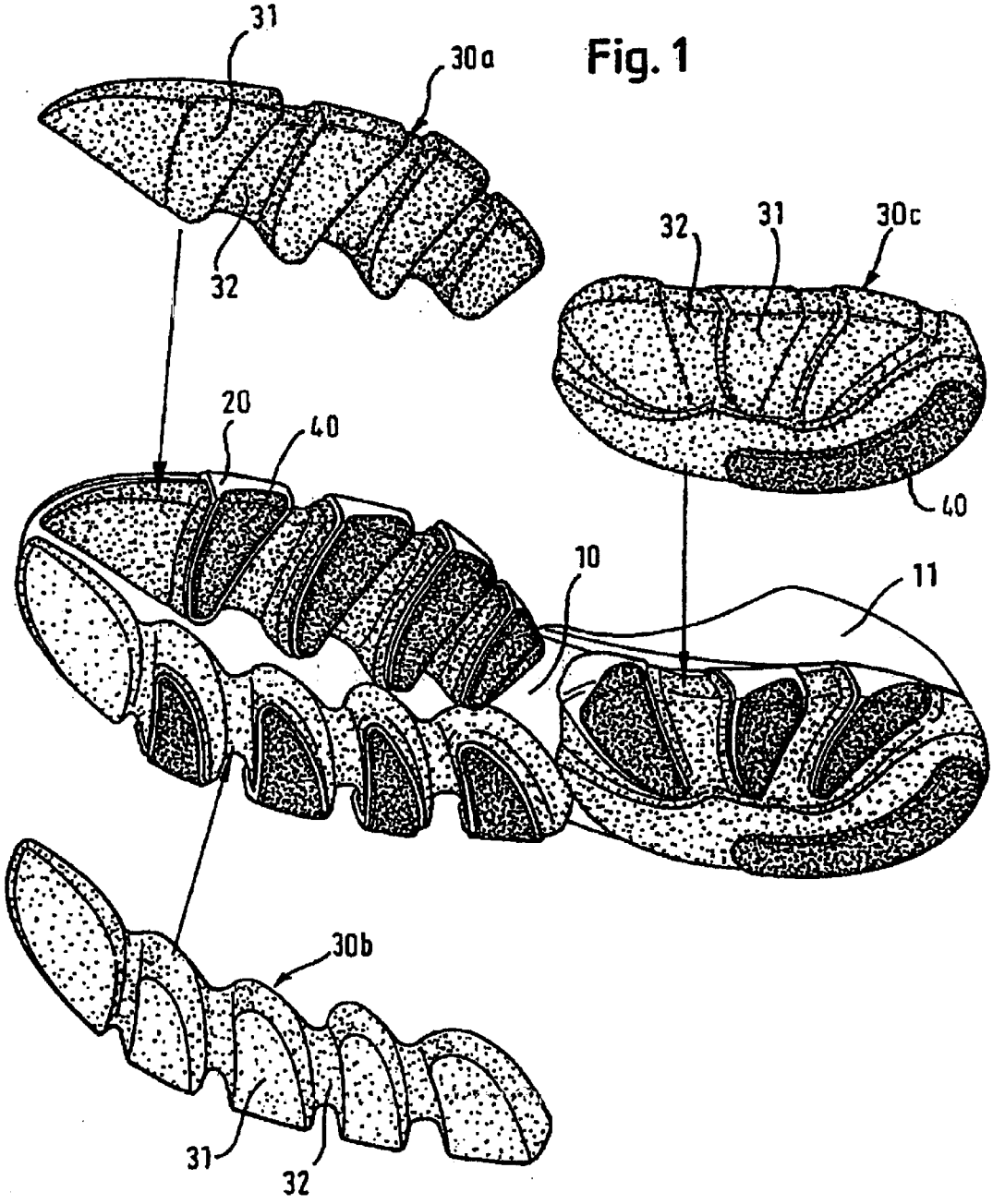

The present invention relates to a sole for a shoe, in particular for a sports shoe.

PRIOR ART

When shoes, in particular sports shoes, are manufactured, the design of the sole has a particular importance. This part not only determines the grip of the shoe on the ground but also controls by its deformability the stress on the muscles and the joints of the wearer of the shoe arising during a step cycle. Further, it influences the energy necessary for running.

Accordingly, it has for many years been the objective of the development of sports shoes to optimize the properties of shoe soles under stress. When in the following the term "sports shoe" is used, this refers to shoes for all kinds of sports, for example jogging shoes, sprint shoes, soccer shoes, but also hiking boots etc.

The properties of a shoe sole under stress can—as the shock absorber of a vehicle—essentially be described by the two terms elasticity and damping. The elastic components of a system are reversibly deformed by an external force and release, when the external force is removed, essentially without any loss the energy stored in the deformation. Damping, however, is called a deformation which is essentially irreversibly transformed into heat and which can therefore not be regained by the system.

As in the case of a shock absorber of a vehicle, it is also in the construction of shoe soles decisive to balance these two aspects in view of the intended use of the shoe, i.e. to either design the sole more elastically—for example for sprint shoes—or to focus on the damping of the shoe for a greater comfort or protection of the joints of the wearer.

In sports shoes according to the prior art the desired balancing was to be achieved by a suitable selection of the material, in particular of the intermediate sole or midsole, i.e. a single element, usually consisting of a foamed material (EVA) with elastical as well as damping properties. However, it was found that soles of this type change due to the constant stress during their lifetime their properties and that in particular the elasticity of the foamed to material significantly decreases. As a result, the shoe becomes too soft, so that the energy needed for one step cycle significantly increases. Further, a too soft shoe is unstable so that the danger of an overpronation arises, i.e. the excessive rolling of the foot to the medial (inner) side or an oversupination, i.e. the excessive rolling to the lateral (outer side) during a step. Since a separate replacement of the midsole is not possible, the complete shoe has to be replaced in such a case.

From the U.S. Pat. No. 5,799,417 a sole construction is known where a movable part of the outsole is provided allowing the replacement or the mounting of different midsole elements in the heel part of the shoe. The movable part of the outsole comprises like a cage the midsole element from all sides and assures thus the mounting to the shoe. However, also in this case damping and elasticity of the shoe sole are combined in a single component, the midsole element, so that a separate adjustment of one of the two aspects is not possible.

It is therefore the problem of the present invention to provide a sole of a shoe, in particular a sports shoe, where the elasticity and the damping of the sole can be independently of each other determined.

SUMMARY OF THE INVENTION

The present invention relates to a sole for a shoe, in particular a sports shoe, with a support plate, at least one damping element arranged below the support plate and at least one spring element mounted to the support plate, where the spring element is essentially L-shaped and thereby encompasses the damping element from the side and from below.

Since the at least one damping element is encompassed by the L-shaped spring element, a deflection of the spring element leads to a simultaneous compression of the damping element. Although both elements are therefore together deformed during ground contact of the sole, the design of the spring element determines the elasticity of the sole, whereas the damping properties are independently determined by the at least one damping element.

According to a preferred embodiment, the damping element and the spring element are releasably mounted to the support plate. This allows on the one hand that both elements can be replaced after prolonged use. On the other hand, the shoe may easily be adapted to different fields of use by different damping and/or spring elements.

Preferably, at least one medial and one lateral damping element are provided to account for different stress on these parts of the sole. For the elasticity this is reflected by the fact that preferably a medial and a lateral spring element are provided. An overpronation or oversupination can therefore be independently of each other avoided.

Preferably, the lateral as well as the medial damping element are encompassed by several medial or lateral spring elements, respectively. Thus, a reliable anchoring to the support plate is provided. The spring elements are preferably mounted to the outer edge of the support plate and extend inwardly. With this orientation, the sole is even with soft damping elements particularly stable in the boarder area to avoid a pronation or supination. On the lower side of the spring elements, contacting directly the ground, additional friction feet are preferably provided to assure a good grip of the sole according to the invention.

Further advantageous developments of the sole according to the invention are subject matter of the dependent claims.

SHORT DESCRIPTION OF THE DRAWING

Figure 2A:
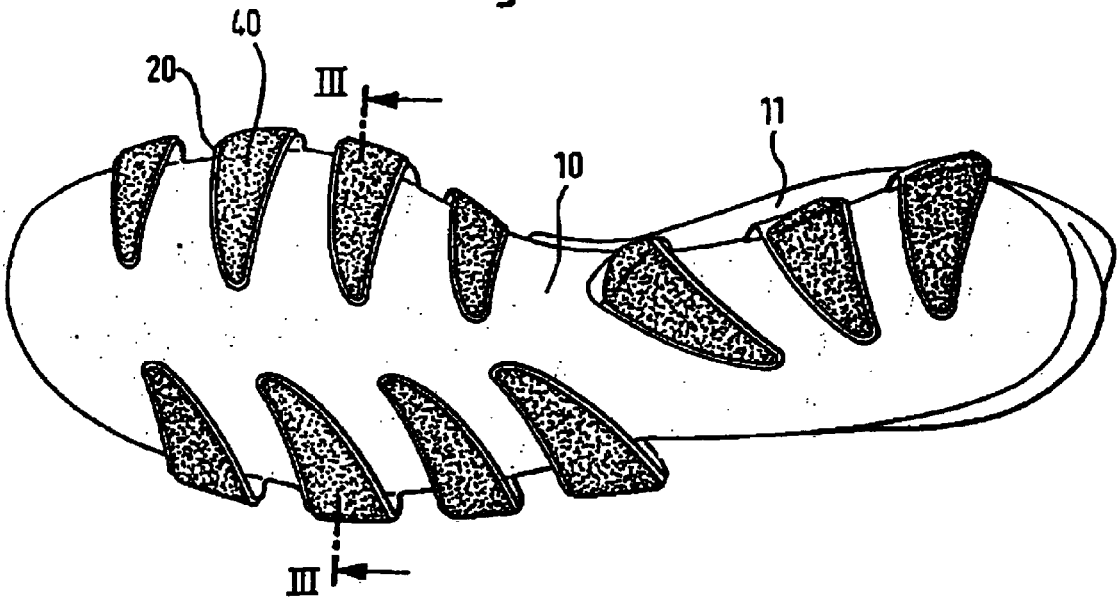
Figure 3:
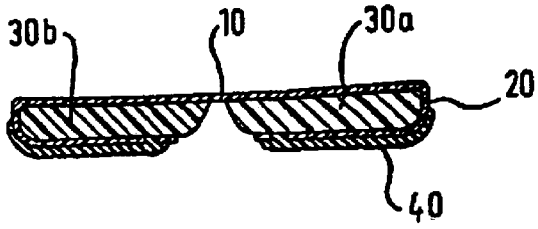
Figure 2B:
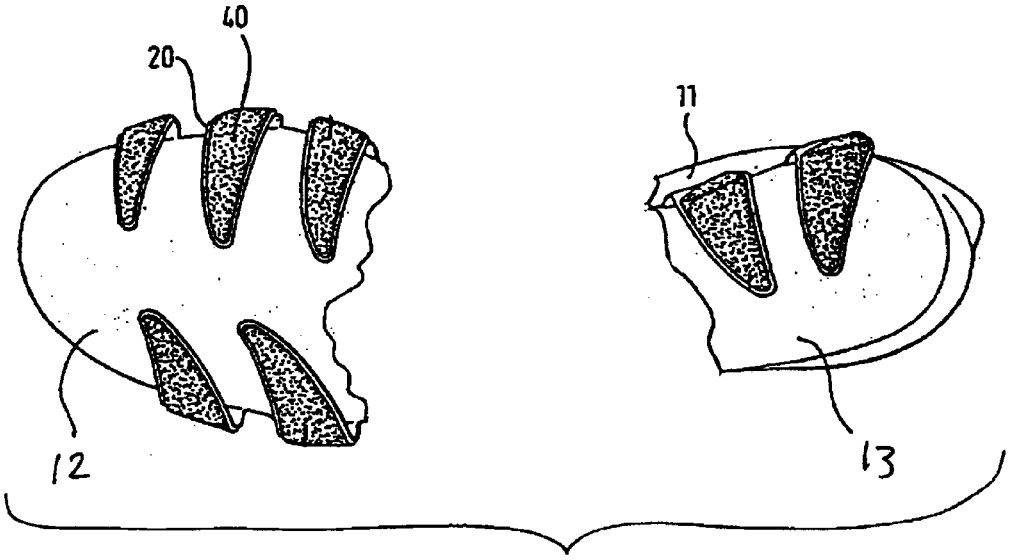

In the following detailed description a presently preferred embodiment of the present invention is described with reference to the drawing, which shows:

FIG. 1: A general view of a preferred embodiment of the sole according to the invention showing the arrangement of three damping elements below the support plate;

FIG. 2A: The preferred embodiment of FIG. 1 with removed damping elements;

FIG. 2B: An alternative embodiment of FIG. 1 having two support plates;

FIG. 3: A section along the line III—III in FIG. 2A with inserted damping elements.

DETAILED DESCRIPTION OF THE INVENTION

With reference to the FIGS. 1, 2A, and 3, the sole according to the invention comprises a support plate 10 and preferably a plurality of spring elements 20 extending therefrom and encompassing with their L-shape the three damping elements 30*a*, 30*b*, 30*c*.

Although the support plate 10 is for the sake of simplicity continuously shown in the Figures, other variations with a more complicated shape are conceivable. The support plate may, for example, have openings or a three-dimensional shape, to selectively support certain parts of the foot, for example the longitudinal or transversal arch of the foot. As an example, an extension 11 is shown on the side in FIGS. 1 and 2A providing an improved guiding of the foot on the medial side and reinforcing at the same time the sole in this area. Referring to FIG. 2B, instead of a single support plate 10, it is conceivable to use different support plates 12, 13 for the forefoot and midfoot part and for the heel part of the foot, respectively. Support plates 12, 13 can be connected by ridges allowing a torsional movement. The stiffness of the support plate 10 and its elasticity is essentially determined by the intended field of use of the shoe. A sprint shoe, for example, will preferably have a comparatively hard and elastic support plate 10.

The spring elements 20 are preferably mounted to the edge of the support plate 10. They can either be simultaneously produced with the support plate 10 or they are later mounted, using either a lasting connection like gluing, melting etc. or a detachable connection like clipping or the like. A detachable mounting allows a later adaptation to changing conditions (a different purpose of the shoe or a change of the weight of the athlete) or the replacement of the spring element, if the elasticity deteriorates. Further, also a later adjustment of the ratio between the elasticity on the medial and the lateral side of the sole is possible.

As can be seen from the cross-section in FIG. 3, the spring elements 20 extend at first essentially vertically downwards and subsequently form a right angle to extend horizontally below the support plate 10. Conceivable is also an embodiment where the vertical sections are semicircular shaped. Further, it is possible that the spring elements 20 have slightly upwardly directed protrusions at their ends (not shown). Thereby the damping elements 30*a*, 30*b*, 30*c* are better anchored below the support plate 10. However, it is essential that the damping elements 30*a*, 30*b*, 30*c* are arranged between the support plate 10 and the horizontal section of the spring elements 20, but a continuous contact of the spring elements 20 With the damping elements 30*a*, 30*b*, 30*c* is not necessary.

At ground contact of the sole according to the invention the spring element 20 is upwardly deflected. This deformation is essentially elastic and provides a downwardly directed restoring force, the amount of which depends on the used material and the wall thickness of the spring element 20. Since the deflection of the spring elements is elastic, the energy stored in their deformation is essentially without any loss returned, when the foot pushes off from the ground.

Further, the upwardly directed movement of the horizontal section of the spring element 20 compresses simultaneously the corresponding damping element 30*a*, 30*b*, 30*c*, whereby a further resistance against the upwardly directed is movement is provided. Depending on the material used for the respective damping element 30*a*, 30*b*, 30*c* this compression is solely viscous, that is non-elastic, so that no further springy restoring force is provided or it is partly elastic, i.e. the damping element 30*a*, 30*b*, 30*c* transforms only part of the deformation in heat and provides an additionally downwardly directed restoring force. As a result, the damping of the sole can be adjusted independently of its elasticity.

The damping elements 30*a*, 30*b*, 30*c* can either be rigidly or releasably mounted to the support plate 10. In case of the first alternative gluing, melting or other techniques are appropriate, whereas for a releasable connection a clipping to the support plate and/or the spring elements 20 or the use of a a hook and fastening material (for example that sold under the trade mark Velcro® is conceivable. In case of the second alternative the damping properties of the sole can later be adjusted to changing requirements or the damping elements can be replaced after intensive wear.

The damping and the elasticity of the sole is preferably adjusted in accordance with the different requirements on different parts of the sole. In the lateral heel part preferably no elastic spring elements 20 are provided but the damping element 30*c* contacts directly the ground. Thus, the sole is comparatively soft in this part of the sole, in which for the major part of all wearers of a shoe the first ground contact takes place during a step cycle, and thereby protects the foot and knee joints against the strong ground reaction forces arising during ground contact. In contrast thereto, a plurality of spring elements 20 is arranged in the midfoot and forefoot part to facilitate an elastic, forwardly directed push-off.

Preferably, the spring elements 20 taper below the support plate 10 and terminate approximately in the center of the sole (see FIGS. 2A and 3). This allows, together with the use of a separate medial and lateral damping elements 30*a*, 30*b*, respectively, to differently design the elastic and damping properties of the shoe in the two slides. Thus, overpronation or oversupination of the foot can be selectively avoided. In the preferred embodiment, for example, the medial damping element 30*a* is shown with a darker hatch to indicate a less soft material compared to the damping elements 30*b* and 30*c*.

In a simpler embodiment (not shown) a single damping element is arranged in the forefoot and midfoot part extending on the medial as well as on the lateral side. However, the medial and the lateral side of the single damping element may have different material properties.

In the preferred embodiment shown in the Figures, a single damping element 30*a*, 30*b* is encompassed on the medial and on the lateral side, respectively, of the forefoot and midfoot part by a plurality of spring elements 20. Possible are also other numbers and distributions of the spring and damping elements. It may be advantageous, for example, to combine several spring elements 20 to a single element (not shown) to provide thereby a greater continuous contact area with the ground. Further, it is possible to use for the forefoot part other damping elements and/or spring elements as in the midfoot part.

In the preferred embodiment shown in the Figures, the damping elements 30*a*, 30*b*, 30*c* comprise each elevated contact surfaces 31 and intermediate, retracted connecting parts 32. Thus, it is avoided that the damping elements 30*a*, 30*b*, 30*c* themselves contact the ground and are damaged thereby.

On the side of the spring elements 20 directed to the ground preferably additional friction feet 40 are provided. Since in the lateral heel part, as described above, no spring element 20 is provided in the preferred embodiment, an additional friction foot 40 is directly arranged on the damping element 30*c* to assure also a good grip during the first ground contact with the heel. Preferably, the friction feet 40 extend also on to the vertical sections of the spring elements 20, to assure a good grip also in case of inclined or sideways ground contact.

With the friction feet 40 a modular construction of the sole according to the invention is provided. Whereas the spring elements 20 provide the desired elasticity and the damping elements 30*a*, 30*b*, 30*c* the corresponding damping, the friction feet 40 are solely optimized for the grip on the ground on which the shoe with the sole according to the invention is to be used. If the shoe is used on an even surface, for example the surface of a gymnasium or asphalt, a smoother profile will be used than in case of an all-round running shoe, which is also to be used on a gravel road. In the latter case it is also conceivable to connect the separate friction feet 40 with each other to a form a continuous sole layer to avoid that dirt accumulates in recesses of the preferred embodiment shown in the Figures.

The spring elements 20 are preferably made out of a thermoplastic material, such as that sold under the trade mark PEBAX®, whereas for the damping elements preferably a foamed material based on EVA is used, for example the material used on shoes sold by adidas under the trademark adiPRENE®.

What is claimed is:

1. A sole for a shoe, comprising:

a support plate;

at least one damping element arranged below the support plate; and at least one spring element comprising a ground-engaging surface and mounted to the support plate wherein the ground-engaging surface engages the ground when the shoe is in use, wherein the spring element is essentially L-shaped and thereby encompasses the damping element from a side and from below.

2. A sole according to claim 1, wherein at least one of the damping element and the spring element is releasably mounted to the support plate.

3. A sole according to claim 1, wherein a single damping element extends continuously from a lateral to a medial side of a forefoot and midfoot part of the sole.

4. A sole according to claim 1, wherein at least one medial and one lateral damping element are provided.

5. A sole according to claim 4, wherein at least one medial and one lateral spring element are provided.

6. A sole according to claim 5, wherein the lateral damping element is encompassed by several lateral spring elements, and the medial damping element is encompassed by several medial spring elements.

7. A sole according to claim 6, wherein the spring elements are mounted to an outer edge of the support plate and extend inwardly.

8. A sole according to claim 7, wherein the spring elements taper in the direction of a center of the sole.

9. A sole according to claim 8, wherein the spring elements terminate in the center of the sole.

10. A sole according to claim 1, wherein the ground-engaging surface comprises a friction foot.

11. A sole according to claim 1, wherein at least one of the spring elements rests on elevated contact surfaces of at least one of the damping elements.

12. A sole according to claim 1, wherein the at least one of the damping elements are arranged in a forefoot and midfoot part of the sole.

13. A sole according to claim 1, wherein a further damping element is encompassed by further spring elements in the heel part.

14. A sole according to claim 1, wherein the support plate comprises an extension on a side for a support of the foot on the side.

15. A sole according to claim 1, wherein the support plate is divided into two parts.

16. A shoe having a sole according to claim 1.

* * * * *